US005454870A

United States Patent [19]

Sieberth

[11] Patent Number: 5,454,870

[45] Date of Patent: Oct. 3, 1995

[54] COATING DEVICE HAVING AN APPLICATION SLOT FORMED BETWEEN AN APPLICATOR ROLL AND A DOSAGING DOCTOR

[75] Inventor: Ralf Sieberth, Appleton, Wis.

[73] Assignee: J.M Voith GmbH, Germany

[21] Appl. No.: 211,144

[22] PCT Filed: Jul. 26, 1993

[86] PCT No.: PCT/EP93/01981

§ 371 Date: Mar. 22, 1994

§ 102(e) Date: Mar. 22, 1994

[87] PCT Pub. No.: WO94/02256

PCT Pub. Date: Feb. 3, 1994

[30] Foreign Application Priority Data

Jul. 27, 1992 [DE] Germany ..... 42 24 726.8

[51] Int. Cl.[6] ..... B05C 5/00

[52] U.S. Cl. ..... 118/258; 15/256.5; 15/256.51; 118/104; 118/118; 118/216; 118/248; 118/261; 118/313; 118/410; 118/413; 162/281

[58] Field of Search ..... 118/70, 104, 110, 118/118, 203, 216, 248, 258, 261, 304, 313, 325, 410, 413; 101/167, 169, 155, 157, 365; 162/281; 15/256.5, 256.51, 256.52; 427/356, 358

[56] References Cited

U.S. PATENT DOCUMENTS

| | | | |
|---|---|---|---|
| 3,152,918 | 10/1964 | Kraus | 118/304 |
| 4,185,399 | 1/1980 | Gladish | 15/256.51 |
| 4,358,481 | 11/1982 | Wallstén | 118/413 |
| 4,860,686 | 8/1989 | Kato et al. | 118/410 |
| 4,903,632 | 2/1990 | Sollinger | 118/410 |
| 4,920,913 | 5/1990 | Knop et al. | 118/413 |
| 5,192,591 | 3/1993 | Chance | 118/410 |

FOREIGN PATENT DOCUMENTS 0272996 6/1988 European Pat. Off. .

*Primary Examiner*—Karen M. Hastings
*Assistant Examiner*—Laura E. Edwards
*Attorney, Agent, or Firm*—Ostrolenk, Faber, Gerb & Soffen

[57] ABSTRACT

A coating device having an applicator roll which forms an application slot with the backup roll which conducts the web of material. Adjoining the applicator slot is a pressure space which is formed at the outlet side of the application slot and between the applicator roll and the backup roll. A flexible guide wall having a shape which approximates or is adapted to the surface of the backup roll and/or can be adapted thereto by the Coanda effect itself, which wall forms a narrow slot along the web of material downstream from the pressure space. The wall is at such a slight distance away from the web that the formation of drips or streaks in the applied coating by the centrifugal force is excluded. The dosaging place for the final dosaging is formed by a dosaging doctor.

16 Claims, 1 Drawing Sheet

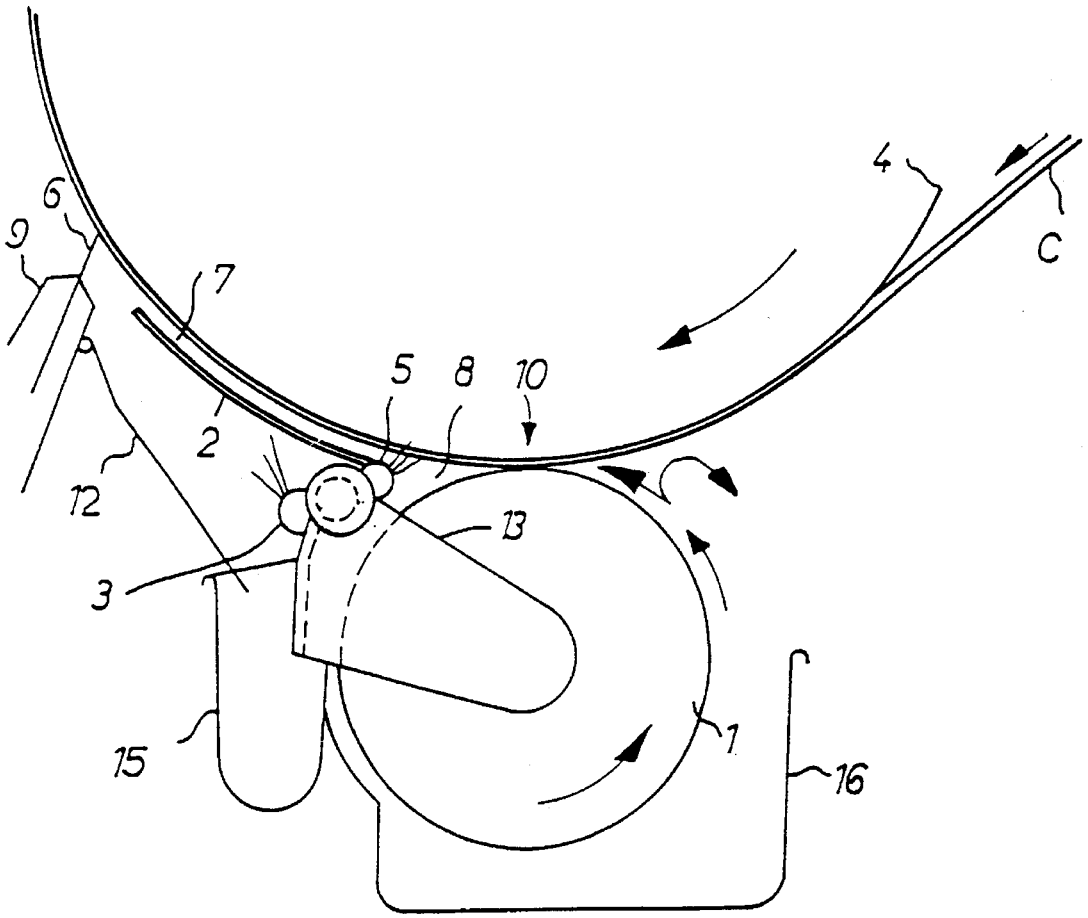
4
C
6
9
7
5
8
10
2
12
13
3
15
1
16

COATING DEVICE HAVING AN APPLICATION SLOT FORMED BETWEEN AN APPLICATOR ROLL AND A DOSAGING DOCTOR

BACKGROUND OF THE INVENTION

The present invention relates to a coating device for a paper web using an applicator roll, and particularly to means for applying a uniform coating layer onto the web on the backing roll. Such a coating device is known from EP 403845. In this connection, the applicator roll is frequently also referred to as a scoop roll, since the coating composition is, so to speak, scooped out of a reservoir and fed to the backup roll in the region of the application slot where the backup roll conducts the web of material to be coated, which generally consists of paper or cardboard. In this connection, only a predosing is effected in the applicator slot so that a doctor element is generally also provided later on on the same backup roll on the web of material in order to effect the final dosaging. The disadvantages of this device become particularly clear with high speeds of the web of more than about 800 meters per minute, so that said patent describes an improved arrangement which does away with the applicator roll. The problems which arise in this connection have, however, also not been completely solved as yet.

SUMMARY OF THE INVENTION

The object of the present invention is so to develop a coating device with which high speeds of the web of 1000 meters per minute and, in particular, more than 1200 meters per minute, are possible.

This object is achieved in accordance with the invention by a coating device has an applicator roll which forms an application slot with the backup roll which conducts the web of material around it. Adjoining the applicator slot is a space, which is formed at the outlet side of the application slot and between the applicator roll and the backup roll. Downstream of that space, there is a preferably flexible guide wall having a shape which approximates or is adapted to the surface of the backup roll and/or can be adapted thereto by the Coanda effect itself, which wall is spaced radially out from and forms a narrow slot along the web of material. The wall is at such a slight distance away from the web that the formation of drips or streaks in the applied coating, which might be caused by the centrifugal force, is excluded. The dosaging place for the final dosaging is formed by a dosaging doctor located past the end of the wall.

In this connection, the rapidly moving coating composition applied to the web is reduced or constricted to a given thickness between the web and the flexible wall by the difference in pressure. Furthermore, due to the Coanda effect, this layer of coating, despite the centrifugal speed which is acting upon it, remains as a uniform film on the web, from which layer the final layer thickness is formed when an excess amount of coating composition is scraped off also uniformly by the subsequent doctor element.

BRIEF DESCRIPTION OF THE DRAWING

The invention will be described below with reference to the sole figure of the drawing, which shows the device basically in a side view.

DETAILED DESCRIPTION OF A PREFERRED EMBODIMENT

In the figure, 1 is the applicator roll, 4 the backup roll, and C the web of material. A holder 13 for flexible wall element 2 is mounted here in the region of the axis of the applicator roll 1. The wall 2 has a free end downstream of its holder. In this connection, a space 8 is formed between the flexible wall 2, the applicator roll 1, and the backup roll 4 or web of material C, from which space excess coating composition can be fed back to the reservoir 16 or else to another reservoir. For the starting-up process, a spray nozzle 5 is provided which preferably sprays a liquid, which may also be the coating composition, into the space 8.

The coating composition therefore passes from the reservoir 16, conveyed on the surface of the applicator roll 1, to the application slot 10 over the space 8 another into the slot 7 which is formed between the flexible wall 2 and the backup roll 4 or web of material C. Here, the coating composition is reduced to a small or smaller thickness of film than in the applicator slot 10. The coating composition first travels further on the web of material and arrives at the final dosaging element, which in this case is a doctor in the form of a coating blade 6 located downstream of the free end of the wall. This coating blade is supported by a mount 9 on which a deflection plate 12 is fastened in order to conduct into a trough 15 the coating composition which has been scraped off.

The slot 7 is at least about 50 mm long and the final dosaging point of the doctor 6 is arranged at most 30 mm behind the end of the slot 7 so that the coating composition is not thrown off from the surface of the roll by the centrifugal force.

The flexible wall 2 is very flexible, so that, as a result of the difference in pressure between the outer side of the wall—mainly atmospheric pressure—and the pressure in the channel formed along the web of material by the flexible wall, the wall is pressed against the web of material and thus adjusts the size of the slot there. This application force is possibly supported by a curtain-like nozzle jet produced by a system of nozzles 3, which is necessary, in particular, for the application of the flexible wall during the start-up time. This curtain jet may consist of air or else of another fluid, for instance water. However, air is preferred.

The flexible wall is so thin and flexible—for instance made of foil—that it experiences a deflection of at least 3 mm at its free end, with a difference in pressure of 0.1 bar on its two sides. The slot 7 formed by the guide wall 2 is in the range from approximately constant to slightly wedge shaped, having a maximum difference in width from the upstream supported start point to the downstream free end point of at most 18%. The individual directions of movement of the various parts and of the coating composition are furthermore indicated by arrows in the figure.

By the device in accordance with the invention, a very uniform film of coating composition is predosed onto the web of material, the final dose being then determined, just as uniformly, by the coating blade.

The material of which the flexible wall 2 can be made may be very different such as, for instance, stainless steel, possibly provided with an anticorrosion layer, steel having a ceramic layer sprayed on the side thereof which faces the web, a carbon-fiber composite foil, etc.

I claim:

1. A coating device for coating a surface of a web, the coating device comprising:

a backup roll for supporting and guiding a portion of the web as the web moves past the coating device for coating the surface of the web;

an applicator roll for carrying a coating composition from a reservoir to a space at the surface of the web supported on the backup roll, the applicator roll being located relative to the backup roll so as to define a first slot between the applicator roll and the backup roll where the applicator roll begins application of the coating composition to the web of material supported on the backup roll;

a flexible guide wall having a shape approximating the shape of the surface of the backup roll, wrapped partly around the backup roll and forming a second slot with and along the web of material downstream of the space along a rotation path of the web and the roll, the guide wall being positioned for receiving the coating composition from the space at the surface of the web and for reducing the thickness of the coating composition received from the space so as to produce a uniform film of coating composition on the web; and a dosaging doctor positioned at the surface of the web past the flexible guide wall in the path of the web for removing excess coating composition from the web so that a final layer of coating composition having a desired thickness remains on the web.

2. The coating device of claim 1, wherein the guide wall has an outside surface facing away from the backup roll and an inside surface facing towards the backup roll and a material and a thickness of the guide wall are such that the guide wall is flexible enough to be deformed by a difference in pressure on the outside wall and the inside wall so as to adjust a width of the second slot formed between the guide wall and the web of material.

3. The coating device of claim 2, wherein the guide wall has an upstream end located adjacent the space and a downstream free end, the guide wall having a degree of flexibility that upon the occurrence of a pressure difference of 0.1 bar on the outside and inside surfaces of the guide wall, the free end of the guide wall is deflected by at least 3 mm.

4. The coating device of claim 3, further comprising means at the upstream end of the guide wall for supporting the guide wall so that the guide wall extends along the applicator roll, and the free end is downstream of the upstream end which is supported.

5. The coating device of claim 3, wherein the flexible guide wall is supported such that the second slot formed between the guide wall and the web on the backing roll has a shape that is variable between a shape that is approximately the same as a shape of the surface of the backup roll and a wedge shape and the second slot formed by the guide wall and the web of material has a maximum difference in width between the upstream end of the guide wall and the downstream end of the guide wall of at most 18%.

6. The coating device of claim 3, wherein the dosaging doctor is located at most about 30 mm downstream of the free end of the guide wall to prevent the coating composition from being thrown off of the surface of the backup roll.

7. The coating device of claim 2, wherein the flexible guide wall is supported such that the second slot formed between the guide wall and the web on the backing roll has a shape that is variable between a shape that is approximately the same as a shape of the surface of the backup roll and a wedge shape and the slot formed by the guide wall and the web of material has a maximum difference in width between the upstream end of the guide wall and the downstream end of the guide wall of at most 18%.

8. The coating device of claim 2, further comprising means for supplying fluid pressure to the outside surface of the guide wall.

9. The coating device of claim 8, further comprising means for delivering a curtain shaped lubrication jet in the direction of the second slot between the flexible guide wall and the web of material.

10. The coating device of claim 2, further comprising means at the upstream end of the guide wall for supporting the guide wall so that the guide wall extends along the applicator roll, and the free end is downstream of the upstream end which is supported.

11. The coating device of claim 1, further comprising a holder for supporting the flexible guide wall at one end of the flexible guide wall so that the guide wall extends along the applicator roll.

12. The coating device of claim 11, wherein the holder is mounted on a longitudinal axis of the applicator roll.

13. The coating device of claim 11, further comprising a spray device mounted on the holder and located for spraying a fluid into the space at the surface of the web supported on the backup roll.

14. The coating device of claim 11, wherein the guide wall has an outside surface facing away from the backup roll and an inside surface facing towards the backup roll, the coating device further comprising at least one nozzle mounted on the holder and positioned for applying a fluid to the outside surface of the flexible guide wall.

15. The coating device of claim 14, wherein the at least one nozzle is formed to apply a curtain shaped fluid jet against the outside surface of the guide wall.

16. The coating device of claim 1, wherein the second slot is at least about 50 mm in length.

* * * * *